United States Patent [19]

Calderon

[11] 4,104,130

[45] Aug. 1, 1978

[54] COKE QUENCHING CAR

[76] Inventor: Albert Calderon, 1065 Melrose Dr., Bowling Green, Ohio 43402

[21] Appl. No.: 703,857

[22] Filed: Jul. 9, 1976

[51] Int. Cl.[2] ..... C10B 39/14

[52] U.S. Cl. ..... 202/230; 105/254; 202/227

[58] Field of Search ..... 202/227, 230; 105/254, 105/255; 201/39

[56] References Cited

U.S. PATENT DOCUMENTS 3,869,352 3/1975 Allen et al. ..... 202/227

FOREIGN PATENT DOCUMENTS 34,305 3/1935 Denmark ..... 202/227
414,138 5/1925 Fed. Rep. of Germany ..... 201/39
875,039 4/1953 Fed. Rep. of Germany ..... 202/227

*Primary Examiner*—Morris O. Wolk
*Assistant Examiner*—Roger F. Phillips

[57] ABSTRACT

Quenching car having an inclined surface for supporting coke to be quenched, a moveable gate which in a first position retains the coke and in a second position permits discharge of coke from the inclined surface, and a bottom wall which guides the coke from the inclined surface across a space and over the wall of a reservoir carried on said quench car which will catch and hold excess quench water which drains between the inclined surface and the gate means.

6 Claims, 2 Drawing Figures

COKE QUENCHING CAR

The present invention relates to quenching cars also known as hot-cars, used in the art of coke making to contain the coke during the quenching operation and for the delivery of the coke after quenching to a storage area.

A conventional quenching car generally, is of two designs, namely, an inclined bottom with side gates, or fixed sides and a drop bottom, to effect the discharge of the coke after the quenching operation. The side located in the direction of the discharge, possesses holes in order to permit excess water to run out. The main disadvantage of the present quenching cars, either of the inclined bottom or the drop-bottom design, is that at the conclusion of the quenching cycle the quenching car must be delayed for drainage or if not delayed the excess water in the car is discharged on the track causing problems particularly in bad weather.

The instant invention has for its main object to contain excess water caused by the quenching operation, in order to prevent the discharge of the excess water onto the track or the vicinity thereof.

Another object of this invention is to provide means to selectively discharge the excess water contained in the car at a pre-destined location and prevent the drainage of this excess water haphazardly on or near the track.

Other objects of this invention will appear from the following detailed description and appended claims.

Reference is made to the accompanying drawings forming a part of this specification wherein like reference characters designate corresponding parts in the views.

Figure 1:
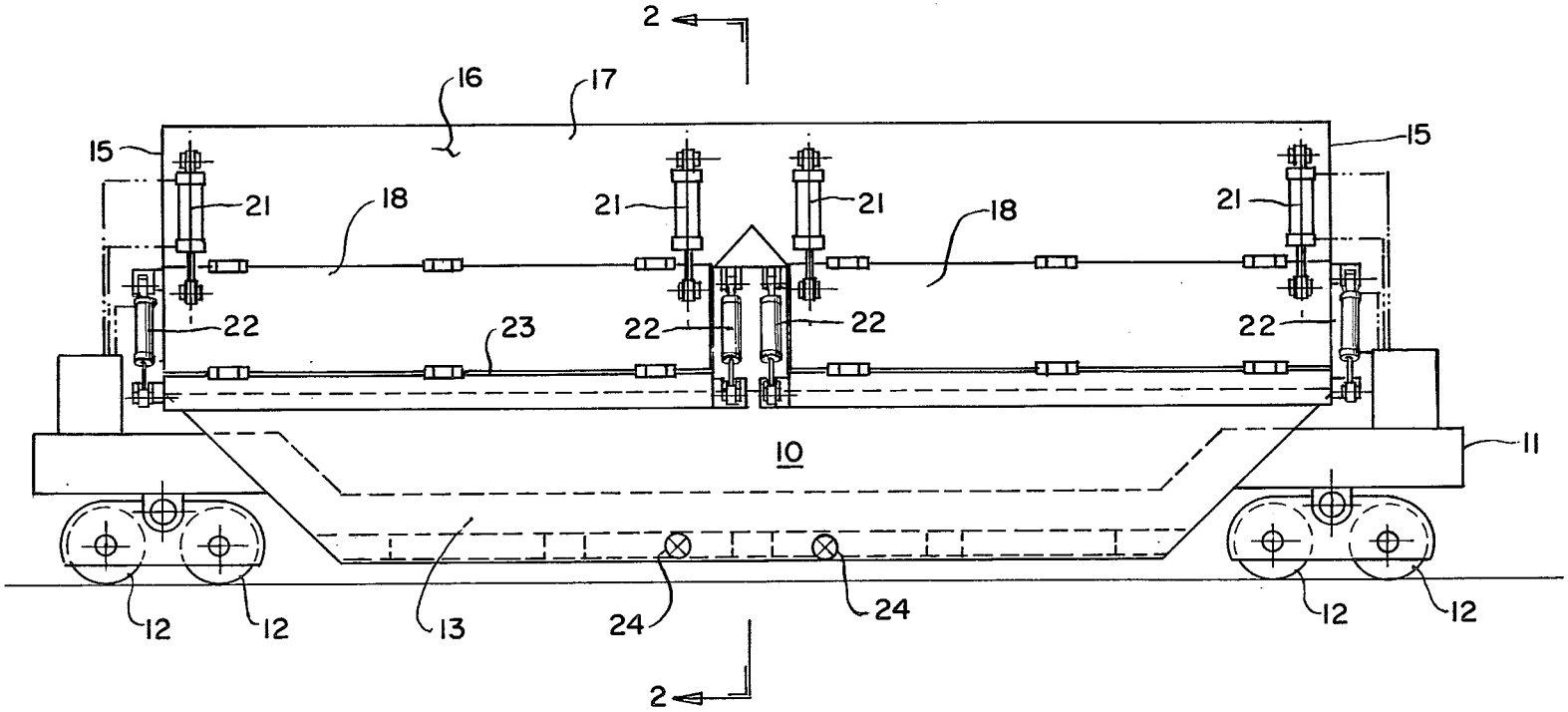
FIG. 1 is an elevational view showing the invention.

Before explaining in detail the present invention, it is to be understood that the invention is not limited to its application and to the details of construction and arrangement of the parts illustrated in the accompanying drawings since the invention is capable of other embodiments. Also, it is to be understood that the phraseology or terminology herein is for the purpose of description and not limitation.

DETAILED DESCRIPTION OF DRAWINGS

In the drawings, 10 indicates the improved coke quenching car. It preferably possesses base 11 mounted on wheels 12 to form a carriage. Water container 13 is disposed between the wheels for the containment and storage of the excess water. Container 13 possesses valves 24 for the discharge of the water. Above container 13, inclined bottom 14 is mounted and surrounded by sides 15 at each end and 16 on the discharge side. Side 16 is preferably made of upper section 17 and lower section 18 in such a way that section 18 comprises rotatable gate means used for the discharge of the coke. Bottom 14 is also preferably made of 2 sections, fixed inclined portion 19 and rotatable portion 20. Actuating means 21 open and close gate means 18 and actuating means 22 lift or drop section 20. Actuating means 21 and 22 may operate pneumatically, hydraulically or mechanically. Clearance 23 is provided between inclined portion 19 and rotatable portion 20, to permit water to fall into container 13.

While the operation of the apparatus of the present invention may be comprehended from a study of the foregoing description it is believed that the operation may be further explained as hereinafter set forth:

OPERATION

Figure 2:
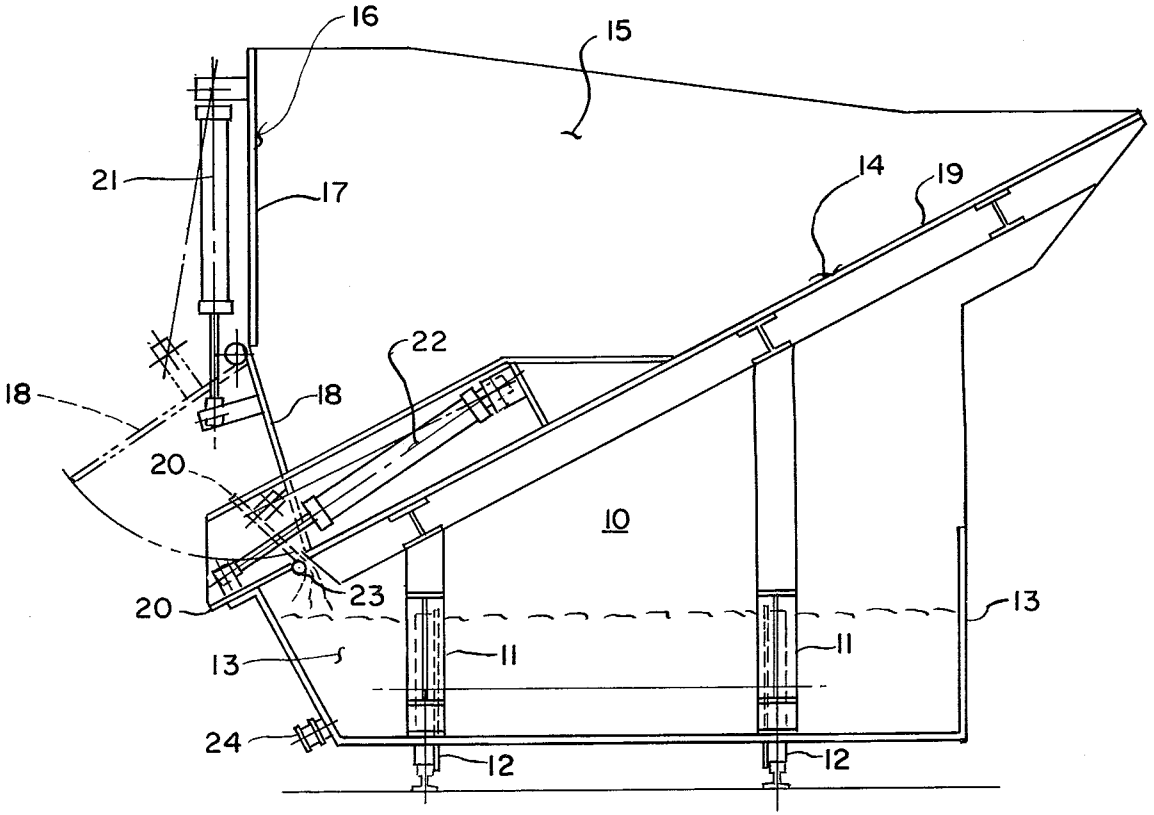
FIG. 2 is a sectional view taken at 2—2 of FIG. 1.

Referring to the drawings, coke is discharged into the area confined by ends 15, side 16 and bottom 14, with gate means 18 in the position shown in solid lines and rotatable end 20 of bottom 14 in the dotted position. During the period of the running of water into car 10, excess water is directed into container 13, through hinge clearance 23, the water falling into container 13 being shown in dotted by FIG. 2. During the discharge of coke from the car onto a storage area, end 20 is rotated from its dotted position to the solid position shown by FIG. 2, and gate means 18 swings from its solid position to the phantom position also shown in FIG. 2.

While the invention has been described with respect to an inclined bottom quenching car it is to be understood that the invention can also assume a drop bottom design. The mode of operation described was not intended to limit the invention to the exact description. All variations falling within the purview of the appended claims are also claimed.

I claim:

1. Apparatus comprising a movable carriage for supporting a body of coke as the body of coke is quenched with liquid to reduce the temperature of the body of coke, said carriage comprising a substantially unbroken surface portion which is inclined with respect to a horizontal plane so that liquid disposed thereon may advance toward the bottom thereof under the influence of gravity, gate means associated with said substantially unbroken surface portion, said gate means including at least one gate member which is selectively movable to a first position to limit the range of movement of a body of coke disposed on said substantially unbroken surface portion under the influence of gravity and which is selectively movable to a second position to permit discharge of the body of coke from said substantially unbroken surface portion, means defining a liquid reservoir supported by said carriage and disposed below said substantially unbroken surface portion, said reservoir including an upwardly extending wall portion having an upper end spaced from the lower end of said substantially unbroken surface portion, a bottom wall means disposed in the space between the upper end of said upwardly extending wall portion and the lower end of said substantially unbroken surface portion for guiding coke under the influence of gravity across said space when said gate member is in said second position, said bottom wall means including a fluid passage between the bottom of said substantially unbroken surface portion and said reservoir when said gate member is in said first position, said gate member being positioned relative to said substantially unbroken surface when said gate member is in said first position so as to allow liquid to flow therebetween, thus establishing and maintaining fluid communication between said substantially unbroken surface portion, said fluid passage, and said reservoir to allow quenching liquid to drain from the body of coke into said reservoir.

2. Apparatus as defined in claim 1 wherein said bottom wall means comprises a bottom wall member mounted for movement between a first position in which it is disposed across said space between the upper end of said upwardly extending wall portion and the lower end of said substantially unbroken surface and a second position in which a portion thereof is spaced from the upper end of said upwardly extending wall portion.

3. Apparatus as defined in claim 2 wherein a portion of said movable bottom wall member is spaced from the lower end of said substantially unbroken surface portion and forms said fluid passage therewith when said bottom wall member is in said second position to allow fluid communication of liquid at the bottom of said substantially unbroken surface portion with said reservoir, said bottom wall member including a surface which substantially resists discharge of particulate matter between the bottom of said substantially unbroken surface portion and said reservoir when said bottom wall member is in said first position.

4. Apparatus as defined in claim 3 wherein said gate member includes a first wall member mounted for pivotal movement about an axis which is fixed with respect to said carriage, and means for pivoting said first wall means to said first and second positions, said bottom wall member comprising a second wall member mounted for pivotal movement about an axis which is fixed with respect to said carriage, and means for pivoting said second wall member to said first and second positions.

5. Apparatus as defined in claim 1 including valve means carried by said carriage for discharging collected liquid from said reservoir.

6. Apparatus as defined in claim 1 wherein said valve means is selectively operable to discharge liquid from said reservoir at specified locations.

* * * * *